US008488999B2

(12) United States Patent
Mihara et al.

(10) Patent No.: US 8,488,999 B2
(45) Date of Patent: Jul. 16, 2013

(54) DEVELOPING DEVICE AND IMAGE FORMING APPARATUS HAVING A DEVELOPER CONVEYING SECTION WITH A SPIRAL BLADE

(75) Inventors: Koichi Mihara, Osaka (JP); Takafumi Nagai, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 79 days.

(21) Appl. No.: 13/231,180

(22) Filed: Sep. 13, 2011

(65) Prior Publication Data

US 2012/0063813 A1 Mar. 15, 2012

(30) Foreign Application Priority Data

Sep. 15, 2010 (JP) ..... P2010-207211

(51) Int. Cl.
*G03G 15/08* (2006.01)

(52) U.S. Cl.
USPC ..... 399/254; 399/256

(58) Field of Classification Search
USPC ..... 399/254, 256, 258; 366/244, 279, 366/318, 320, 325.3, 330.1, 343
See application file for complete search history.

(56) References Cited

U.S. PATENT DOCUMENTS

| | | | | |
|---|---|---|---|---|
| 5,249,019 | A * | 9/1993 | Ishida et al. | 366/318 |
| 5,312,184 | A * | 5/1994 | Cocchi | 366/302 |
| 2007/0231017 | A1* | 10/2007 | Sato | 399/262 |
| 2008/0013998 | A1 | 1/2008 | Kumagai et al. | |
| 2008/0025763 | A1 | 1/2008 | Suenami | |

FOREIGN PATENT DOCUMENTS

| | | |
|---|---|---|
| CN | 201156165 Y | 11/2008 |
| JP | 63-189875 | 8/1988 |
| JP | 08-030084 | 2/1996 |
| JP | 10-221936 | 8/1998 |
| JP | 2001-066861 | 3/2001 |
| JP | 2002-040768 | 2/2002 |
| JP | 2004-151354 | 5/2004 |
| JP | 2007-93895 | 4/2007 |
| JP | 2008-33109 | 2/2008 |
| JP | 2008-090188 | 4/2008 |
| JP | 2009-109741 | 5/2009 |

* cited by examiner

*Primary Examiner* — Robert Beatty
(74) *Attorney, Agent, or Firm* — Nixon & Vanderhye P.C.

(57) ABSTRACT

A developing device that is capable of securing an amount of developer that can be stored in a developer tank while suppressing the bending of a developer conveying section, as well as an image forming apparatus are provided. In a developer tank of a developing device, there is provided a first developer conveying section that includes a first rotation shaft member having a columnar shape in which grooves extending in an axial line direction are formed, and a first spiral blade that is spirally wound around the first rotation shaft member and conveys the developer by rotation around the axial line of the first rotation shaft member.

13 Claims, 11 Drawing Sheets

DEVELOPING DEVICE AND IMAGE FORMING APPARATUS HAVING A DEVELOPER CONVEYING SECTION WITH A SPIRAL BLADE

CROSS-REFERENCE TO RELATED APPLICATION

This application claims priority to Japanese Patent Application No. 2010-207211, which was filed on Sep. 15, 2010, the contents of which are incorporated herein by reference in its entirety.

BACKGROUND OF THE TECHNOLOGY

1. Field of the Technology

The present technology relates to a developing device and an image forming apparatus.

2. Description of the Related Art

Copiers, printers, facsimiles, or the like include an image forming apparatus that forms an image by electrophotography. The electrophotographic image forming apparatus forms an electrostatic latent image on a surface of an image bearing member (photoreceptor) using a charging device and an exposure device, develops the electrostatic latent image by supplying developer using a developing device, transfers the developer image on the photoreceptor to a recording medium such as recording paper using a transfer section, and fixes the developer image onto the recording paper using a fixing device and thereby forms an image.

The developer supplied to the photoreceptor by the developing device is contained in a developer tank provided in the developing device. The developer contained in the developer tank is conveyed to a developing roller provided in the developing device. The developing roller rotates while bearing the developer on a surface thereof, and supplies the developer to the photoreceptor. The developer is charged while being conveyed to the developing roller, and the charged developer is moved from the developing roller to the photoreceptor by electrostatic force between the surface of the photoreceptor and the electrostatic latent image. In this manner; the developing device develops the electrostatic latent image on the surface of the photoreceptor, and forms the developer image.

In recent years, accompanying the increase in speed and miniaturization of the image forming apparatus, the decrease in size of a developing device and the increase in developing process speed has been demanded. For example, Japanese Unexamined Patent Publication JP-A 2009-109741 discloses a circulation-type developing device including a developer conveying section that has a first conveying path, a second conveying path, a first communication path, and a second communication path formed by a partition provided inside a developer tank, and that conveys the developer in the first conveying path and the second conveying path in directions opposite to each other. The developer conveying section disclosed JP-A 2009-109741 is an auger screw type member that includes a rotation shaft member having a columnar shape and a spiral blade spirally wound around the rotation shaft member, and developer is circularly conveyed by the developer conveying section and thereby the increase in a developing speed is promoted.

In regard to the developer conveying section disclosed in JP-A 2009-109741, when the size of the developer conveying section is decreased with a shape thereof maintained as it is, the developer conveying section is apt to be bent in a direction orthogonal to an axial line of the rotation shaft member, and as a result, there is a problem in that the developer conveying section and a bottom of a developer tank may come into contact with each other. To avoid this contact, it is necessary to increase the size of the developer tank, such that it is difficult to decrease the size of the entirety of developing device.

In regard to this, when the developer conveying section is configured to have a shape in which the inner diameter of the spiral blade and the outer diameter of the rotation shaft member equal to this inner diameter are increased with the outer diameter of the spiral blade maintained as it is, the strength of the rotation shaft member is increased, and therefore it is possible to suppress the bending. However, when the outer diameter of the rotation shaft member is increased, an occupying volume of the rotation shaft member in the developer tank is increased, and therefore an amount of developer that can be stored in the developer tank is diminished.

SUMMARY OF THE TECHNOLOGY

The technology is made to solve the above-described problems, and an object thereof is to provide a developing device that is capable of securing an amount of developer that can be stored in a developer tank while suppressing the bending of a developer conveying section, as well as an image forming apparatus.

The technology provides a developing device comprising:

a developer tank that stores developer;

a developer conveying section provided in the developer tank, including a rotation shaft member having a columnar shape in which grooves extending in an axial line direction of the rotation shaft member are formed, and a spiral blade that is spirally wound around the rotation shaft member and conveys developer by rotation around the axial line of the rotation shaft member; and a developing roller that bears and supplies the developer.

The developer conveying section includes a rotation shaft member having a columnar shape in which grooves extending in an axial line direction of the rotation shaft member are formed, and a spiral blade that is spirally wound around the rotation. shaft member. The rotation shaft member having a columnar shape in which grooves are formed has high rigidity in a direction orthogonal to the axial line direction of the rotation shaft member compared to a rotation shaft member having a columnar shape with the same cross-sectional area in an axial line direction. Therefore, the developer conveying section according to the technology is hard to be bent. In addition, the rotation shaft member according to the technology has a columnar shape in which grooves extending in an axial line direction of the rotation shaft member are formed, such that the rotation shaft member has a small occupying volume in the developer tank compared to a rotation shaft member having a columnar shape with the same outer diameter. Therefore, it is possible to store a large amount of developer in the developer tank. Therefore, the developing device according to the technology can secure an amount of developer that can be stored in the developer tank while suppressing bending of the developer conveying section. As a result, it is possible to realize the decrease in size.

Further, it is preferable that the spiral blade is fixed to the rotation shaft member in a state where the spiral blade comes into contact with only an outer edge of the rotation shaft member.

The spiral blade comes into contact with only an outer edge of the rotation shaft member. Therefore, a gap is formed between the spiral blade and the groove portion of the rotation shaft member. Therefore, it is possible to bear the developer in a groove portion facing the spiral blade as well as in a groove portion not facing the spiral blade and agitate the developer in a peripheral direction of the rotation shaft member. Therefore, according to the developing device of the technology, it is possible to quickly charge the developer compared to a state where a gap between the spiral blade and the groove portion of the rotation shaft member is filled, and as a result, it is possible to realize the increase in developing process speed.

Further, it is preferable that a shape of the grooves is a V-shape or U-shape in a cross section orthogonal to the axial line direction.

A shape of the grooves is a V-shape or a U-shape in a cross section orthogonal to the axial line direction. Therefore, it is possible to suppress the developer from remaining in the grooves.

Further, it is preferable that a number of the grooves is 3 or more and 5 or less.

The number of the grooves is 3 or more and 5 or less. When the number of grooves is 2 or less, it is apt to be bent in a specific direction. In addition, in a case where an area of cross section orthogonal to the axial line direction of the rotation shaft member is made to be constant, when the number of grooves is 6 or more, the area of cross section orthogonal to the axial line direction in each of the grooves becomes small compared to a case where the number of the grooves is 5 or less, and as a result, the amount of developer that can be borne in the grooves is decreased and therefore an agitating effect of the developer is decreased. Contrary to this, when the number of grooves is 3 or more and 5 or less, it is hard to be bent in a specific direction, and it is possible to agitate the developer while sufficiently securing the amount of developer that can be borne in the grooves.

Further, it is preferable that the grooves are formed to be equally spaced in a circumferential direction of the rotation shaft member in regard to a cross section orthogonal to the axial line direction.

The grooves are equally spaced in a circumferential direction of the rotation shaft member in regard to a cross section orthogonal to the axial line direction. Therefore, it is possible to suppress the bending of the developer conveying section equally in all directions orthogonal to the axial line direction of the rotation shaft member.

In addition, the technology provides an electrophotographic image forming apparatus comprising:

the developing device mentioned above.

The image forming apparatus comprises the developing device mentioned above and forms an image using the developing device. The size of the developing device may be decreased, such that the size of the image forming apparatus also may be decreased.

BRIEF DESCRIPTION OF THE DRAWINGS

Other and further objects, features, and advantages technology will be more explicit from the following detailed description taken with reference to the drawings wherein.

DETAILED DESCRIPTION

Figure 1:
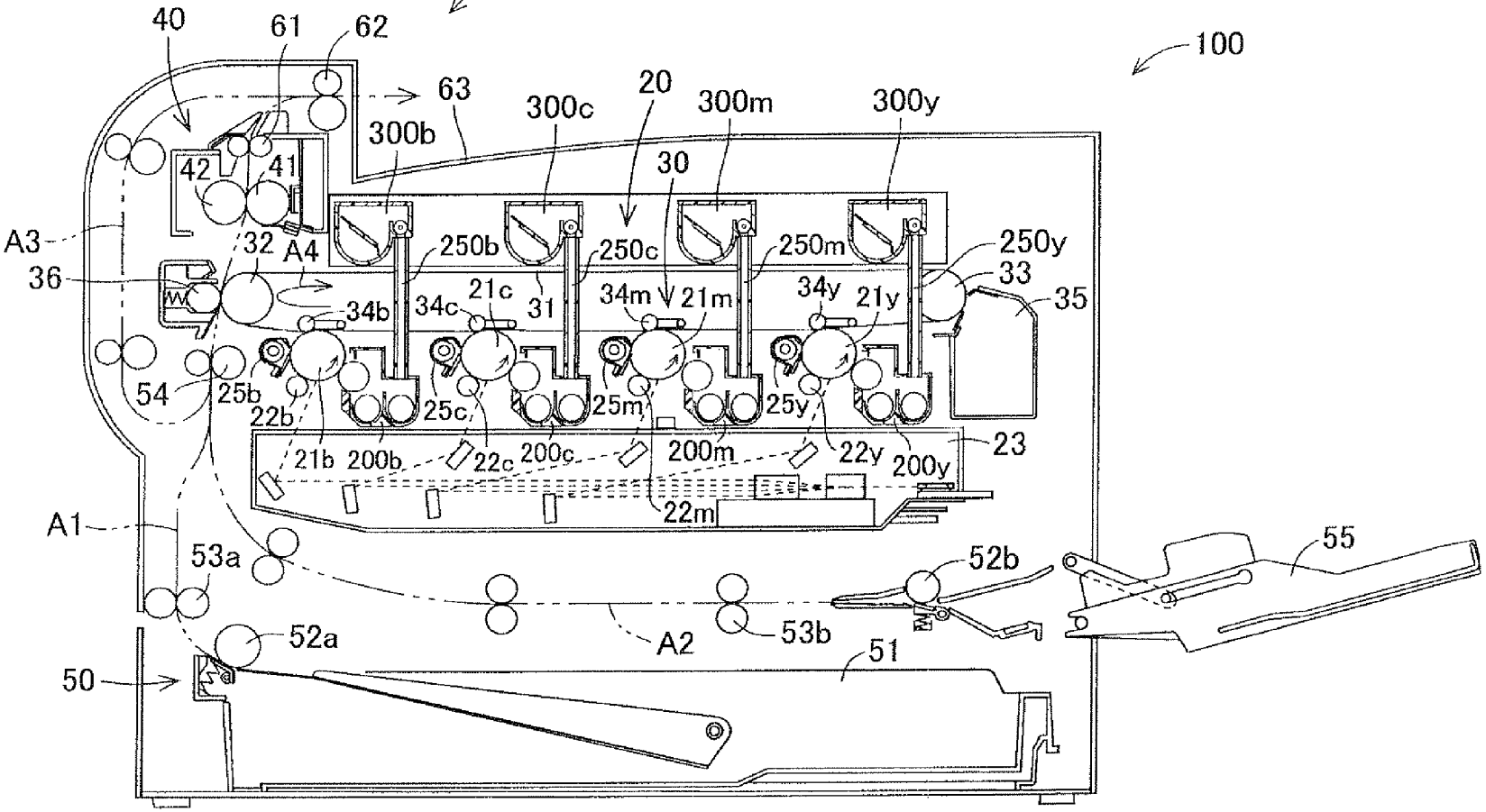
FIG. 1 is a schematic diagram illustrating a configuration of an image forming apparatus.

Now referring to the drawings, preferred embodiments are described below.

First, an image forming apparatus 100 comprising a developing device 200 according to an embodiment will be described. The image forming apparatus 100 is a multi-functional peripheral having a copying function, a printing function, and a facsimile function, and forms a full color image or a monochrome image on a recording medium according to transferred image information. The image forming apparatus 100 has three types of printing mode of a copier mode (copying mode), a printer mode, and a facsimile mode, and a printing mode is selected by a control unit section (not shown) according to a manipulation input from a manipulation section (not shown) and the reception of a printing job transmitted from a personal computer, a mobile terminal apparatus, an information recording medium, an external apparatus using a memory device, or the like.

FIG. 1 is a schematic diagram illustrating a configuration of the image forming apparatus 100. The image forming apparatus 100 includes a toner image forming section 20, a transfer section 30, a fixing section 40, a recording medium feeding section 50, a discharging section 60, and a control unit section (not shown), The toner image forming section 20 includes photoreceptor drums 21*b*, 21*c*, 21*m*, and 21*y*, charging sections 22*b*, 22*c*, 22*m*, and 22*y*, an exposure unit 23, developing devices 200*b*, 200*c*, 200*m*, and 200*y*, cleaning units 25*b*, 25*c*, 25*m*, and 25*y*, toner cartridges 300*b*, 300*c*, 300*m*, and 300*y*, and toner supplying pipes 250*b*, 250*c*, 250*m*, and 250*y*. The transfer section 30 includes an intermediate transfer belt 31, a driving roller 32, a driven roller 33, intermediate transfer rollers 34*b*, 34*c*, 34*m*, and 34*y*, a transfer belt cleaning unit 35, and a transfer roller 36.

The photoreceptor drum 21, the charging section 22, the developing device 200, the cleaning unit 25, the toner cartridge 300, the toner supply pipe 250, and the intermediate transfer roller 34 are disposed for each color to correspond to image information of each color of black (b), cyan (c), magenta (m), and yellow (y) included in color image information. In this specification, in a case where four members corresponding to the colors, respectively, are discriminated, a letter representing each of colors b, c, m and y is attached to the end of a numeral representing each member and this is used as a reference numeral, and in a case where each of the members are collectively referred to, only the numeral representing each of the members is used as a reference numeral.

The photoreceptor drum 21 is supported by a driving unit (not shown) so as to be rotatable around an axial line thereof, and includes a conductive substrate (not shown), and a photoconductive layer formed on a surface of the conductive substrate. The conductive substrate may have various shapes, and for example, a cylindrical shape, a column shape, a thin film sheet shape, or the like may be exemplified. The photoconductive layer is formed of a material showing a conductive property when irradiated with light. As the photoreceptor drum 21, it is possible to use a member including a cylindrical member (conductive substrate) formed of aluminum and a thin film (photoconductive layer) that is formed on an outer circumferential surface of the cylindrical member and is made of, for example, amorphous silicon (a-Si), selenium (Se), or organic photo-semiconductor (OPC).

The charging section 22, the developing device 200, and the cleaning unit 25 are disposed in this order along the rotational direction of the photoreceptor drum 21, and the charging section 22 is disposed on a vertically lower side in relation to the developing device 200 and the cleaning unit 25.

The charging section 22 is a device that charges the surface of the photoreceptor drum 21 at predetermined polarity and potential. The charging section 22 is disposed at a position facing the photoreceptor drum 21 along the longitudinal direction of the photoreceptor drum 21. In the case of contact charging type, the charging section 22 is disposed to come into contact with the surface of the photoreceptor drum 21. In the case of the non-contact charging type, the charging section 22 is disposed to be spaced from the surface of the photoreceptor drum 21.

The photoconductor section 22 is disposed at the periphery of the photoreceptor drum 21 together with the developing device 200 and the cleaning unit 25. It is preferable that the photoconductor section 22 is disposed at a position close to the photoreceptor drum 21 in relation to the developing device 200 and the cleaning unit 25. In this manner, it is possible to reliably prevent occurrence of charging failure of the photoreceptor drum 21.

As the charging section 22, a brush type charging device, a roller type charging device, a corona discharge device, an ion generating device, or the like may be used. The brush type charging device and the roller type charging device are charging devices of contact charging type. In the brush type charging device, a charging brush, a magnetic brush, or the like is usable. The corona discharge device and the ion generating device are charging devices of non-contact charging type. In the corona discharge device, a wire-like discharge electrode, a saw-like discharge electrode, a needle-like discharge electrode, or the like is usable.

The exposure unit 23 is disposed so that light emitted from the exposure unit 23 passes between the charging section 22 and the developing device 200 and the surface of the photoreceptor drum 21 is irradiated with the light. The exposure unit 23 irradiates the surface of each of the photoreceptor drums 21*b*, 21*c*, 21*m*, and 21*y* that are in a charged state with laser light corresponding to image information of each color, respectively, and thereby an electrostatic latent image corresponding to the image information of each color is formed on the surface of each of the photoreceptor drums 21*b*, 21*c*, 21*m*, and 21*y*. As the exposure unit 23, a laser scanning unit (LSU) provided with a laser irradiation section and a plurality of reflective mirrors may be used. As the exposure unit 23, an LED (light emitting diode) array, a unit of suitably combining a liquid crystal shutter and a light source, or the like may be used.

The developing device 200 is a device that develops the electrostatic latent image formed on the photoreceptor drum 21 with a toner, and thereby forms a toner image on the photoreceptor drum 21. A toner supplying pipe 250 that is a cylindrical member is connected to the developing device 200 at a vertically upper part thereof. The details of the developing device 200 will be described later.

The toner cartridge 300 is displaced on a vertically upper side in relation to the developing device 200, and contains an unused toner. The toner supplying pipe 250 is connected to the toner cartridge 300 at a vertically lower part thereof. The toner cartridge 300 supplies the toner to the developing device 200 through the toner supplying pipe 250. The details of the toner cartridge 300 will be described later.

The cleaning unit 25 is a member that removes the toner remaining on the surface of the photoreceptor drum 21 after transferring the toner image onto the intermediate transfer belt 31 from the photoreceptor drum 21 and thereby cleans the surface of the photoreceptor drum 21. As the cleaning unit 25, for example, a plate-like member that scrapes the toner, and a container-like member that recovers the scraped toner are used.

According to the toner image forming section 20, the surface of the photoreceptor drum 21, that is in a uniformly charged state by the charging section 22, is irradiated with laser light corresponding to image information from the exposure unit 23, and thereby an electrostatic latent image is formed thereon. The toner is supplied to the electrostatic latent image on the photoreceptor drum 21 from the developing device 200, and thereby a toner image is formed. The toner image is transferred onto the intermediate transfer belt 31 described later. After the toner image transferred onto the intermediate transfer belt 31, the toner remaining on the surface of the photoreceptor drum 21 is removed by the cleaning unit 25.

The intermediate transfer belt 31 is an endless belt-like member disposed vertically above the photoreceptor drum 21. The intermediate transfer belt 31 is supported around a driving roller 32 and a driven roller 33 with tension and forms a loop-like pathway, and runs in a direction indicated by an arrow A4.

The driving roller 32 is disposed to be rotatable around a axial line thereof by a driving unit (not shown). The driving roller 32 allows the intermediate transfer belt 31 to run in the direction indicated with the arrow A4 by rotation thereof. The driven roller 33 is provided to be rotatable in accordance with rotation. of the driving roller 32, and generates a constant tension to the intermediate transfer belt 31 so that the intermediate transfer belt 31 does not go slack.

The intermediate transfer roller 34 is provided to come into pressure-contact with the photoreceptor drum 21 with the intermediate transfer belt 31 interposed therebetween and to be rotatable around an axial line thereof by a driving unit (not shown). As the intermediate transfer roller 34, for example, a roller member including a conductive elastic member on a surface of a metal (for example, stainless steel) roller having a diameter of 8 to 10 mm may be used. The intermediate transfer roller 34 is connected to a power source (not shown) that applies a transfer bias voltage and has a function of transferring the toner image formed on the surface of the photoreceptor drum 21 to the intermediate transfer belt 31.

The transfer roller 36 is provided to come into pressure-contact with the driving roller 32 with the intermediate transfer belt 31 interposed therebetween, and to be rotatable around an axial line thereof by a driving unit (not shown). At a pressure-contact portion (transfer nip region) between the transfer roller 36 and the driving roller 32, the toner image borne on and conveyed by the intermediate transfer belt 31 is transferred onto a recording medium fed from the recording medium feeding section 50 described later.

The transfer belt cleaning unit 35 is provided to be opposite to the driven roller 33 in relation to the intermediate transfer belt 31, and to come into contact with a toner bearing surface of the intermediate transfer belt 31. The transfer belt cleaning unit 35 is provided to remove the toner on the surface of the intermediate transfer belt 31 and recovers the removed toner after the transfer of the toner image onto the recording medium. When the toner remains attached to the intermediate transfer belt 31 after the transferring of the toner image onto the recording medium, there is a problem that the remaining toner is attached to the transfer roller 36 when the intermediate transfer belt 31 runs. When the toner is attached to the transfer roller 36, the toner may contaminate the rear surface of the next recording medium onto which the transferring is to be performed.

According to the transfer section 30, when the intermediate transfer belt 31 runs while being brought into contact with the photoreceptor drum 21, a transfer bias voltage with a polarity opposite to the charging polarity of the toner on the surface of the photoreceptor drum 21 is applied to the intermediate transfer roller 34, and the toner image formed on the surface of the photoreceptor drum 21 is transferred onto the intermediate transfer belt 31. The toner images of the respective colors formed by the photoreceptor drum 21*y*, the photoreceptor drum 21*m*, the photoreceptor drum 21*c*, and the photoreceptor drum 21*b* are sequentially overlaid and transferred onto the intermediate transfer belt 31 in this order and thereby a full color toner image is formed. The toner image transferred Onto the intermediate transfer belt 31 is conveyed to the transfer nip region by running of the intermediate transfer belt 31 and is transferred onto a recording medium at the transfer nip region. The recording medium having the toner image transferred thereto is conveyed to the fixing section 40 described later.

The recording medium feeding section 50 includes a paper feed box 51, pick-up rollers 52*a* and 52*b*, conveying rollers 53*a* and 53*b*, registration rollers 54, and a paper feed tray 55. The paper feed box 51 is a container-like member that is provided at a vertically lower part of the image forming apparatus 100 and stores recording mediums at the inside of the image forming apparatus 100. The paper feed tray 55 is a tray-like member that is provided in a side wall surface of the image forming apparatus 100 and stores recording mediums at the outside of the image forming apparatus 100. Examples of the recording medium include regular paper, a sheet for color copying, a sheet for an overhead projector, and a postcard.

The pick-up roller 52*a* is a member that takes out the recording mediums stored in the paper feed box 51 one by one and feeds it to a paper conveyance path A1. The conveying rollers 53*a* are a pair of roller-like members, which are provided to come into pressure-contact with each other, and convey the recording medium in the paper conveyance path A1 toward the registration rollers 54. The pick-up roller 52*b* is a member that takes out the recording mediums stored in the paper feed tray 55 one by one and feeds it to a paper conveyance path A2. The conveying rollers 53*b* are a pair of roller-like members, which are provided to come into pressure-contact with each other, and convey the recording medium in the paper conveyance path A2 toward the registration rollers 54.

The registration rollers 54 are a pair of roller-like members, which are provided to come into pressure-contact with each other, and feeds the recording medium fed from the conveying rollers 53*a* or 53*b* to the transfer nip region in synchronization with conveyance of the toner image borne on the intermediate transfer belt 31 to the transfer nip region.

According to the recording medium feeding section 50, in synchronization with conveyance of the toner image borne on the intermediate transfer belt 31 to the transfer nip region, the recording medium is fed to the transfer nip region from the paper feed box 51 or the paper feed tray 55 and then the toner image is transferred onto the recording medium.

The fixing section 40 includes a heating roller 41 and a pressure roller 42. The heating roller 41 is controlled to maintain a predetermined fixing temperature. The pressure roller 42 is a roller that comes into pressure-contact with the heating roller 41. The heating roller 41 nips the recording medium together with the pressure roller 42 while heating the recording medium, and melts toner constituting the toner image and fixes it onto the recording medium. The recording medium having the toner image fixed thereon is conveyed to the discharge section 60 described later.

The discharge section 60 includes conveying rollers 61, discharge rollers 62, and a catch tray 63. The conveying rollers 61 are a pair of roller-like members, which are provided to come into pressure-contact with each other on a vertically upper side of the fixing section 40. The conveying rollers 61 convey the recording medium having an image fixed thereon toward the discharge rollers 62.

The discharge rollers 62 are a pair of roller-like members, which are provided to come into pressure-contact with each other. In the case of one-sided printing, the discharge rollers 62 discharge the recording medium on which the one-sided printing is completed to the catch tray 63. In the case of double-sided printing, the discharge rollers 62 convey the recording medium on which the one-sided printing is completed to the registration rollers 54 through a paper conveyance path A3 and discharges the recording medium on which the double-sided printing is completed to the catch tray 63. The catch tray 63 is provided in the vertically top surface of the image forming apparatus 100 and stores the recording mediums having the image fixed thereon.

The image forming apparatus 100 includes the control unit section (not shown). The control unit section is provided in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD). As for the external device, electrical and electronic devices which can form or obtain the image information and which can be electrically connected to the image forming apparatus 100 can be used. Examples thereof include computers, digital cameras, televisions, video recorders, DVD (Digital Versatile Disc) recorders, HDDVD (High-Definition Digital Versatile Disc) recorders, Blu-ray disc recorders, facsimile machines, and mobile terminal devices.

The computing portion takes out various kinds of data (for example, image formation commands, detection results, and image information) written in the memory portion and the programs for various processes and then makes various determinations. The control portion sends a control signal to the respective devices provided in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices provided in the image forming apparatus 100.

Figure 2:
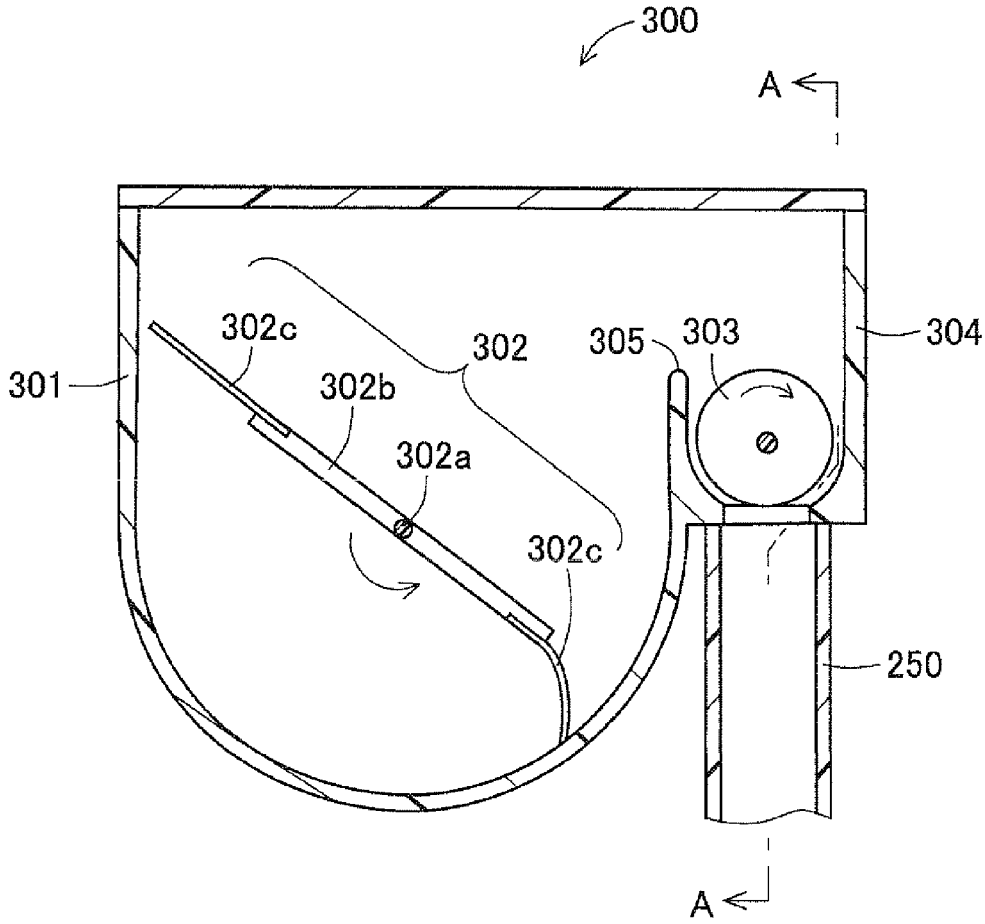
FIG. 2 is a schematic diagram illustrating a configuration of a toner cartridge.
Figure 3:
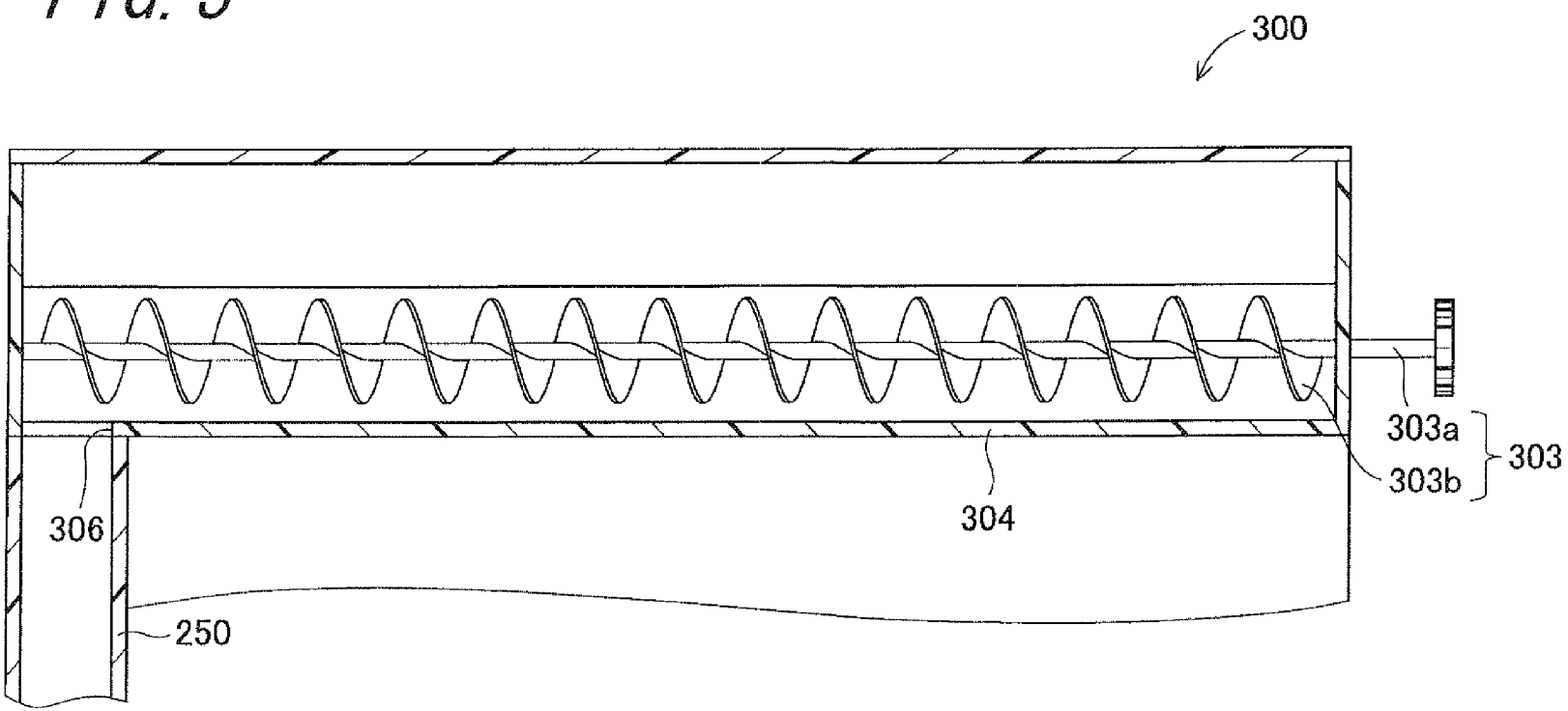
FIG. 3 is a cross-sectional view illustrating the toner cartridge taken along the line A-A shown in FIG. 2.

FIG. 2 is a schematic diagram illustrating a configuration of the toner cartridge 300. FIG. 3 is a cross-sectional view of the toner cartridge 300 taken along the line A-A shown in FIG. 2. The toner cartridge 300 is a device that supplies a toner to the developing device 200 through the toner supply pipe 250. The toner cartridge 300 includes a toner container 301, a toner scooping member 302, a toner discharge member 303 and a toner discharge container 304.

The toner container 301 is a container-like member having an approximately semicircular columnar internal space, and in the internal space, supports the toner scooping member 302 so as to freely rotate and contains an unused toner. The toner discharge container 304 is a container-like member having an approximately semicircular columnar internal space provided along a longitudinal direction of the toner container 301, and in the internal space, supports the toner discharge member 303 so as to freely rotate. The internal space of the toner container 301 and the internal space of the toner discharge container 304 communicate with each other through a communicating opening 305 formed along the longitudinal direction of the toner container 301. The toner discharge container 304 has a discharge port 306 formed on a vertically lower part thereof. To the discharge port 306 of the toner discharge container 304, the toner supply pipe 250 is connected.

The toner scooping member 302 includes a rotation shaft 302*a*, a base member 302*b* and a sliding section 302*c*. The rotation shaft 302*a* is a column-shaped member extending along a longitudinal direction of the toner container 301. The base member 302*b* is a plate-like member extending along the longitudinal direction of the toner container 301, and attached to the rotation shaft 302*a* at a center in a width direction and a thickness direction thereof. The sliding section 302*c* is a member having flexibility and attached to both end parts in the width direction of the base member 302*b*, and is formed of, for example, a polyethylene terephthalate (PET). The toner scooping member 302 scoops the toner inside the toner container 301 into the toner discharge container 304 by which the base member 302*b* performs rotation motion following rotation of the rotation shaft 302*a* around the axial line thereof, whereby the sliding section 302*c* provided at the both end parts in the width direction of the base member 302*b* slides on an inner wall surface of the toner container 301.

The toner discharge member 303 is a member that conveys the toner inside the toner discharge container 304 toward the discharge port 306. The toner discharge member 303 is a so-called auger screw including a toner discharge rotation shaft 303*a*, and a toner discharge blade 303*b* provided around the toner discharge rotation shaft 303*a*.

According to the toner cartridge 300, an unused toner in the toner container 301 is scooped into the toner discharge container 304 by the toner scooping member 302. Then, the toner scooped by the toner discharge container 304 is conveyed to the discharge port 306 by the toner discharge member 303. The toner conveyed to the discharge port 306 is discharged from the discharge port 306 to the outside of the toner discharge container 304, and supplied to the developing device 200 through the toner supply pipe 250.

Figure 4:
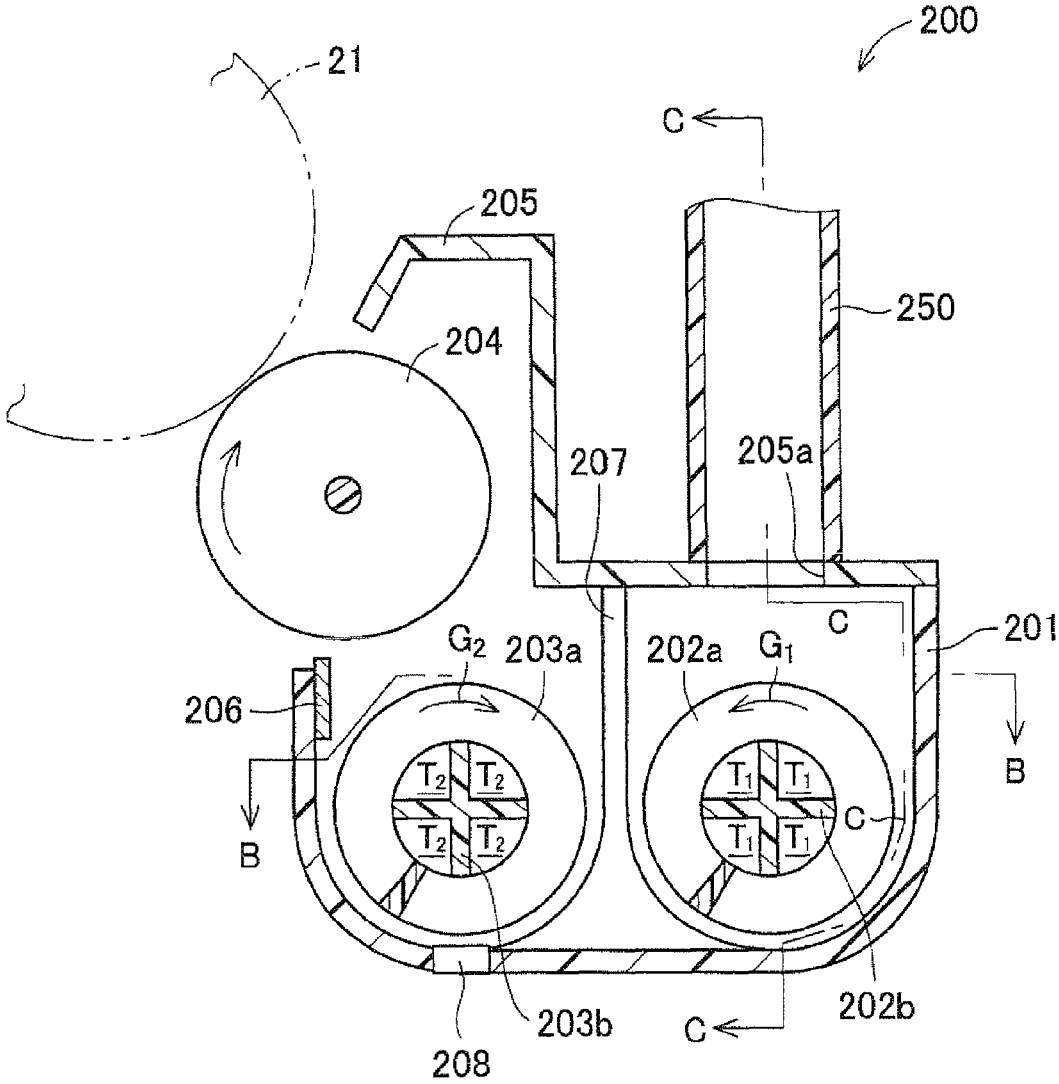
FIG. 4 is a schematic diagram illustrating a configuration of a developing device.
Figure 5:
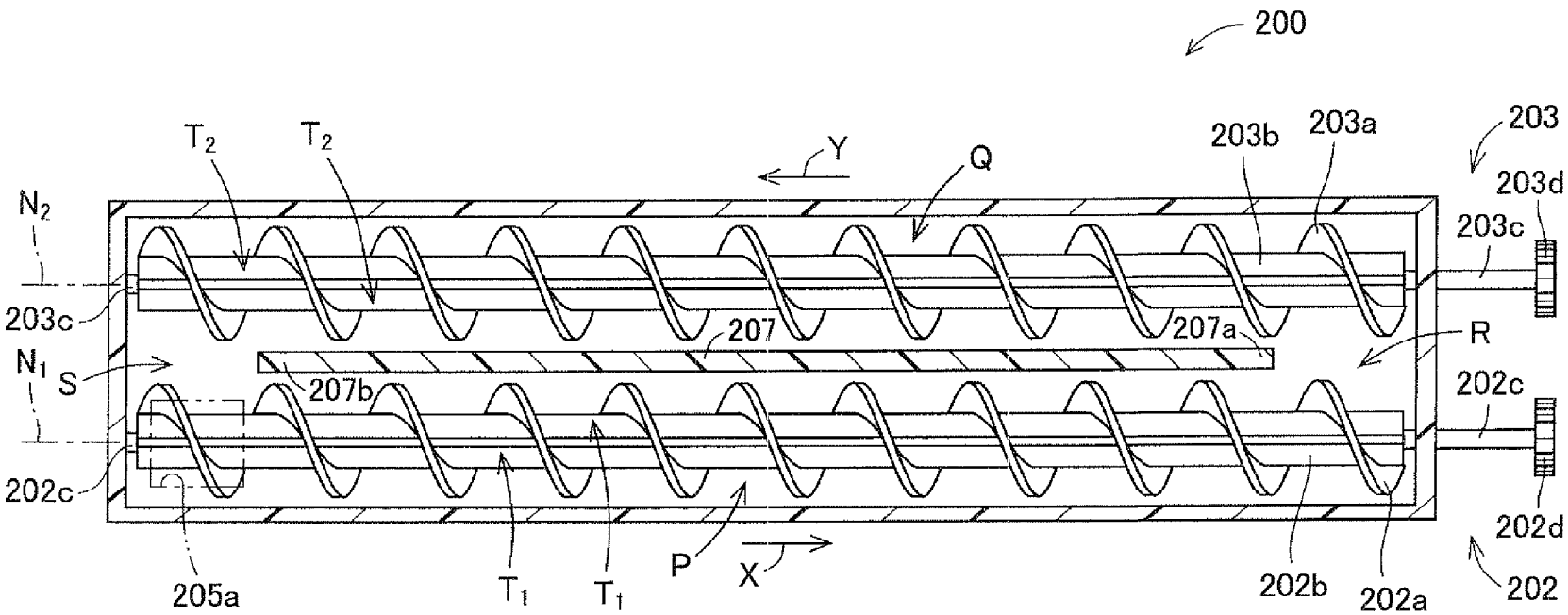
FIG. 5 is a cross-sectional view illustrating the developing device taken along the line B-B shown in FIG. 4.
Figure 6:
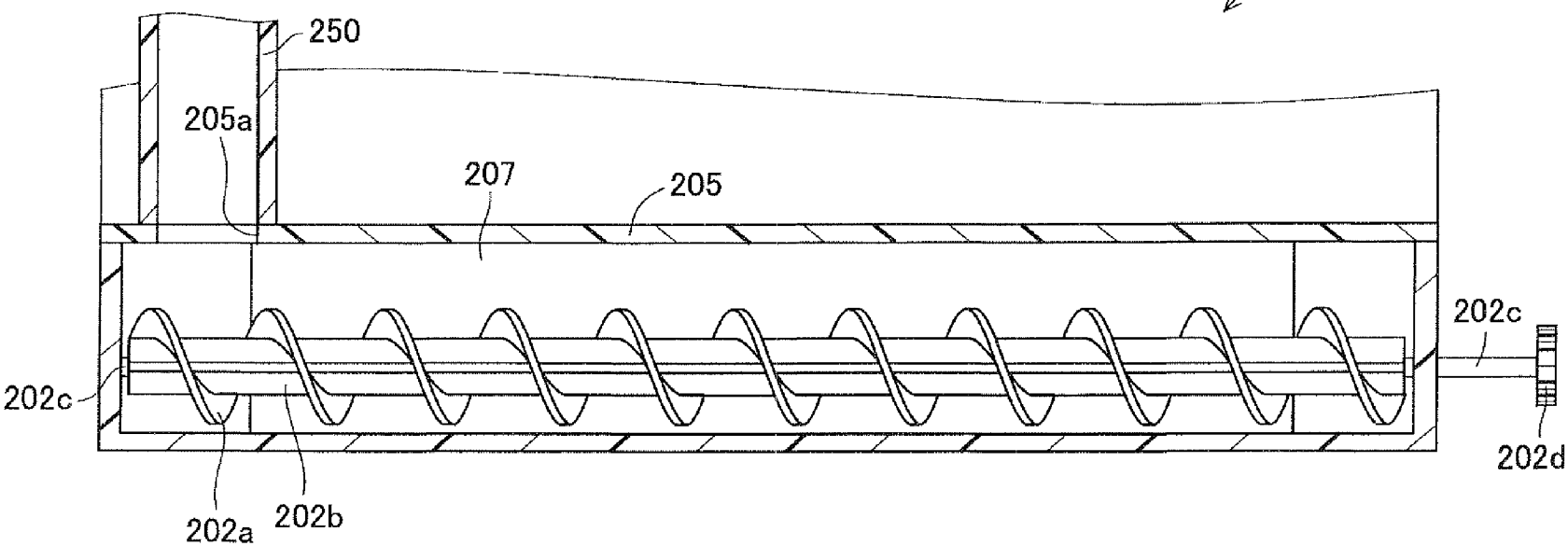
FIG. 6 is a cross-sectional view illustrating the developing device taken along the line C-C shown in FIG. 4.

FIG. 4 is a schematic diagram illustrating a configuration of the developing device 200. FIG. 5 is a cross-sectional view of the developing device 200 taken along the line B-B shown in FIG. 4. FIG. 6 is a cross-sectional view of the developing device 200 taken along the line C-C shown in FIG. 4. The developing device 200 is a device which supplies a toner onto a surface of the photoreceptor drum 21 so as to develop an electrostatic latent image formed on the surface thereof. The developing device 200 includes a developer tank 201, a first developer conveying member 202, a second developer conveying member 203, a developing roller 204, a developer tank cover 205, a doctor blade 206, a partition 207 and a toner concentration detection sensor 208.

The developer tank 201 is a member having an internal space, and contains a developer in the internal space. The developer used in this embodiment may be a one-component developer composed only of a toner, or may be a two-component developer containing a toner and a carrier. In the developer tank 201, there are provided the developer tank cover 205 is provided on the vertically upper side thereof, and in the internal space, the first developer conveying member 202, the second developer conveying member 203, the developing roller 204, the doctor blade 206, and the partition 207. In addition, the toner concentration detection sensor 208 is provided at a vertically lower part (a bottom) of the developer tank 201.

The developing roller 204 includes a magnet roller, and bears the developer inside the developer tank 201 on a surface thereof and supplies the toner contained in the borne developer to the photoreceptor drum 21. To the developing roller 204, a power source (not shown) is connected and a developing bias voltage is applied. The toner borne on the developing roller 204 is, in the vicinity of the photoreceptor drum 21, moved to the photoreceptor drum 21 with an electrostatic force by the developing bias voltage.

The doctor blade 206 is a plate-like member extending in an axial line direction of the developing roller 204, and is provided so that one end in a width direction thereof is fixed to the developer tank 201, and another end thereof has a clearance with respect to the surface of the developing roller 204. The doctor blade 206 is provided so as to have a clearance with respect to the surface of the developing roller 204, and an amount of developer borne on the developing roller 204 is thereby regulated to a predetermined amount. As a material of the doctor blade 206, stainless steel, aluminum, a synthetic resin, or the like is usable.

The partition 207 is a member having a longitudinal shape extending along the longitudinal direction of the developer tank 201 at the substantially center portion of the developer tank 201. The partition 207 is provided between the bottom of the developer tank 201 and the developer tank cover 205 so that both longitudinal ends are spaced from an inner wall surface of the developer tank 201. Due to the partition 207, the internal space of the developer tank 201 is partitioned into a first conveying path P, a second conveying path Q, a first communication path R, and a second communication. path S.

The second conveying path Q is a space that extends along the longitudinal direction of the partition 207 and faces the developing roller 204. The first conveying path P is a space that extends along the longitudinal direction of the partition 207 and faces the second conveying path Q with the partition 207 interposed therebetween. The first communication path R is a space communicating with the first and second conveying paths P and Q on a side of one end 207*a* in the longitudinal direction of the partition 207. The second communication path S is a space communicating with the first and second conveying paths P and Q on a side of the other end 207*b* in the longitudinal direction of the partition 207.

The developer tank cover 205 is detachably provided on a vertically upper side of the developer tank 201. In the developer tank cover 205, a supply port 205*a* is formed. The supply port 205*a* is formed at a position facing the second communication path S vertically above the first conveyance path P. To the developer tank cover 205, at the supply port 205*a*, the toner supply pipe 250 is connected. The toner contained in the toner cartridge 300 is supplied into the developer tank 201 through the toner supply pipe 250 and the supply port 205*a*.

The first developer conveying section 202 is provided inside the first conveying path P. The first developer conveying section 202 conveys the developer inside the developer tank 201 toward the side of the one end 207*a* of the partition 207 in the longitudinal direction from the side of the other end 207*b* in the longitudinal direction of the partition 207. Hereinafter, a conveying direction of the developer by the first developer conveying section 202 is referred to as a conveying direction X.

The first developer conveying section 202 includes a first spiral blade 202*a*, a first rotation shaft member 202*b*, first supporting members 202*c*, and a first gear 202*d*. The first spiral blade 202*a* is provided to be spirally wound around the first rotation shaft member 202*b*. The first rotation shaft member 202*b* is provided in such a manner that an axial line $N_1$ thereof extends in a longitudinal direction of the partition 207. The first rotation shaft member 202*b* has a columnar shape having the axial line $N_1$ direction as en axial line direction thereof in which grooves $T_1$ extending in the axial line $N_1$ direction are formed.

The first rotation shaft member 202*b* is supported by two first columnar supporting members 202*c* at both ends thereof in the axial line $N_1$ direction. Among the two first supporting members 202*c*, the first supporting member 202*c* on the second communication path S side is rotatably supported on an inner wall of the developer tank 201. Among the two first supporting member 202*c*, the first supporting member 202*c* on the first communication path side is connected to the first gear 202*d* at the outside of the developer tank 201. In addition, as another embodiment, the first rotation shaft member 202*b* and the first gear 202*d* may be connected to each other without the first supporting member 202*c* interposed therebetween.

The first rotation shaft member 202*b* rotates around the axial line $N_1$ at 60 rpm to 180 rpm in a rotational direction $G_1$ by a driving unit such as a motor through the first supporting member 202*c* and the first gear 202*d*. The first spiral blade 202*a* rotates around the axial line $N_1$ following rotation of the first rotation shaft member 202*b*, and conveys developer stored in the first conveying path P toward a downstream side in the conveying direction X. As described above, the supply port 205*a* of the developer tank cover 205 is formed in the vicinity of the second communication path S on a vertically upper side of the first conveying path P, so that an unused toner inside the toner cartridge 300 is first supplied toward an upstream side in the conveying direction X in regard to the first conveying path P, and then is conveyed to a downstream side in the conveying direction X by the first developer conveying section 202.

The second developer conveying section 203 is provided inside the second conveying path Q. The second developer conveying section 203 conveys the developer inside the developer tank 201 from the side of the one end 207*a* to the side of the other end 207*b* in the longitudinal direction of the partition 207. Hereinafter, a conveying direction of the developer by the second developer conveying section 203 is referred to as a conveying direction Y.

The second developer conveying section 203 includes a second spiral blade 203*a*, a second rotation shaft member 203*b*, second supporting members 203*c*, and a second gear 203*d*. The second spiral blade 203*a* is provided to be spirally wound around the second shaft member 203*b*. The second rotation shaft member 203*b* is provided in such a manner that an axial line $N_2$ thereof extends in a longitudinal direction of a. partition 207. The second rotation shaft member 203*b* has a columnar shape having the axial line $N_2$ direction as an axial line direction thereof in which grooves $T_2$ extending in the axial line $N_2$ direction are formed.

The second rotation shaft member 203*c* is supported by two second columnar supporting members 203*c* at both ends thereof in the axial line $N_2$ direction. Among the two second supporting members 203*c*, the second supporting member 203*c* on the second communication path S side is rotatably supported on an inner wall of the developer tank 201. Among the two second supporting member 203*c*, the second. supporting member 203*c* on the first communication path R side is connected to the second gear 203*d* at the outside of the developer tank 201. In addition, as another embodiment, the second rotation shaft member 203*b* and the second gear 203*d* may be connected to each other without the second supporting member 203*c* interposed therebetween.

The second rotation shaft member 203*b* rotates around the axial line $N_2$ at 60 rpm to 180 rpm in a rotational direction $G_2$ by a driving unit such as a motor through the second supporting member 203*c* and the second gear 203*d*. The second spiral blade 203*a* rotates around the axial line $N_2$ following rotation of the second rotation shaft member 203*b*, and conveys developer stored in the second conveying path Q toward a downstream side in the conveying direction Y.

In this embodiment, the first developer conveying section 202 and the second developer conveying section 203 are configured to have the same shape. However, in the present embodiment, the first developer conveying section 202 and the second developer conveying section 203 is not necessarily to have the same shape, for example, one of the first developer conveying section 202 and the second developer conveying section 203 may have an auger screw shape. The first developer conveying section 202 will be described later in detail.

The toner concentration detection sensor 208 is mounted in the bottom of the developer tank 201 on a vertically lower side of the second developer conveying section 203, and is provided so that a sensing surface thereof is exposed to the second conveying path Q. The toner concentration detection sensor 208 is electrically connected to a toner concentration control unit (not shown).

The toner concentration control unit performs control of causing the toner discharge member 303 to rotate according to a toner concentration detection result obtained by the toner concentration detection sensor 208 and supplying the toner to the inside of the developer tank 201. More specifically, the toner concentration control unit determines whether or not toner concentration detection result obtained by the toner concentration detection sensor 208 is lower than a predetermined set value, and sends a control signal to the driving unit that causes the toner discharge member 303 to rotate, thereby causing the toner discharge member 303 to rotate at a predetermined cycle when it is determined that the result is lower than the set value.

To the toner concentration detection sensor 208, a power source (not shown) is connected. The power source applies, to the toner concentration detection sensor 208, a driving voltage for driving the toner concentration detection sensor 208 and a control voltage for outputting the toner concentration detection result to the toner concentration control unit. The application of the voltage to the toner concentration detection sensor 208 by the power source is controlled by a control unit (not shown).

As the toner concentration detection sensor 208, a general toner concentration detection sensor is usable, and examples thereof include a transmissive optical detection sensor, a reflective optical detection sensor, and a permeability detection sensor. Among the toner concentration detection sensors, it is preferable to use the permeability detection sensor. Examples of the permeability detection sensor include TS-L (trade name, manufactured by TDK corporation), TS-A (trade name, manufactured by TDK corporation), and TS-K (trade name, manufactured by TDK corporation).

According to the developing device 200 configured as described above, in the developer tank 201, the developer is circulation-conveyed in the order of the first conveying path P, the first communication path R, the second conveying path Q, and the second communication path S. A part of the developer that is circulation-conveyed in this manner is borne on the surface of the developing roller 204 at the second conveying path Q and the toner in the borne developer is moved to the photoreceptor drum 21 and is sequentially consumed. When the toner concentration detection sensor 208 detects that a predetermined amount of toner is consumed, an unused toner is supplied to the first conveying path P from the toner cartridge 300. The supplied toner is diffused in the developer while being conveyed in the first conveying path P.

Hereinafter, the first developer conveying section 202 will be described in detail. Since the second developer conveying section 203 has the same configuration as that of the first developer conveying section 202, the description thereof will be omitted.

Figure 7:
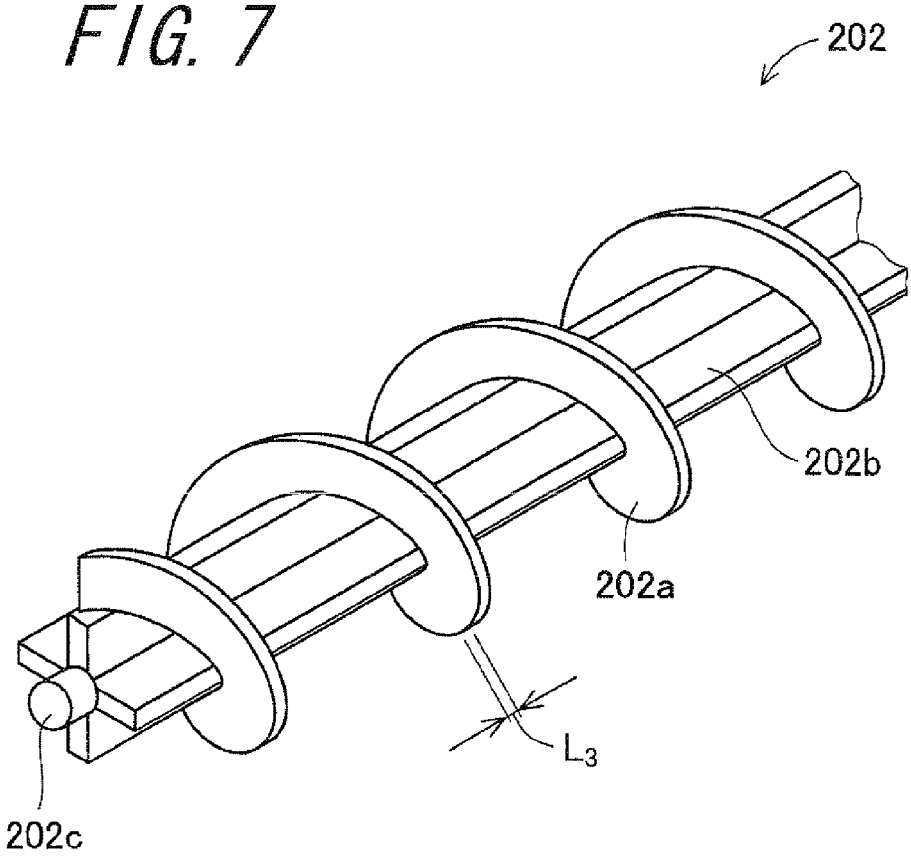
FIG. 7 is a perspective view illustrating a first developer conveying section.
Figure 8:
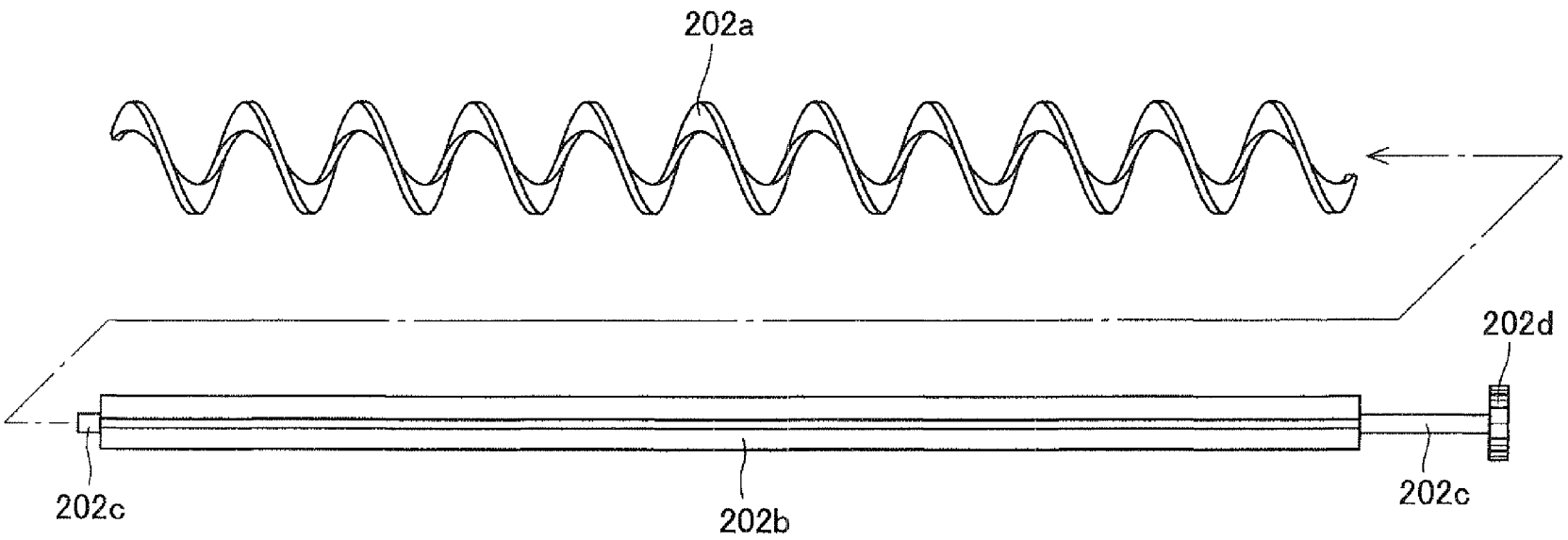
FIG. 8 is an exploded view illustrating the first developer conveying section.
Figure 9:
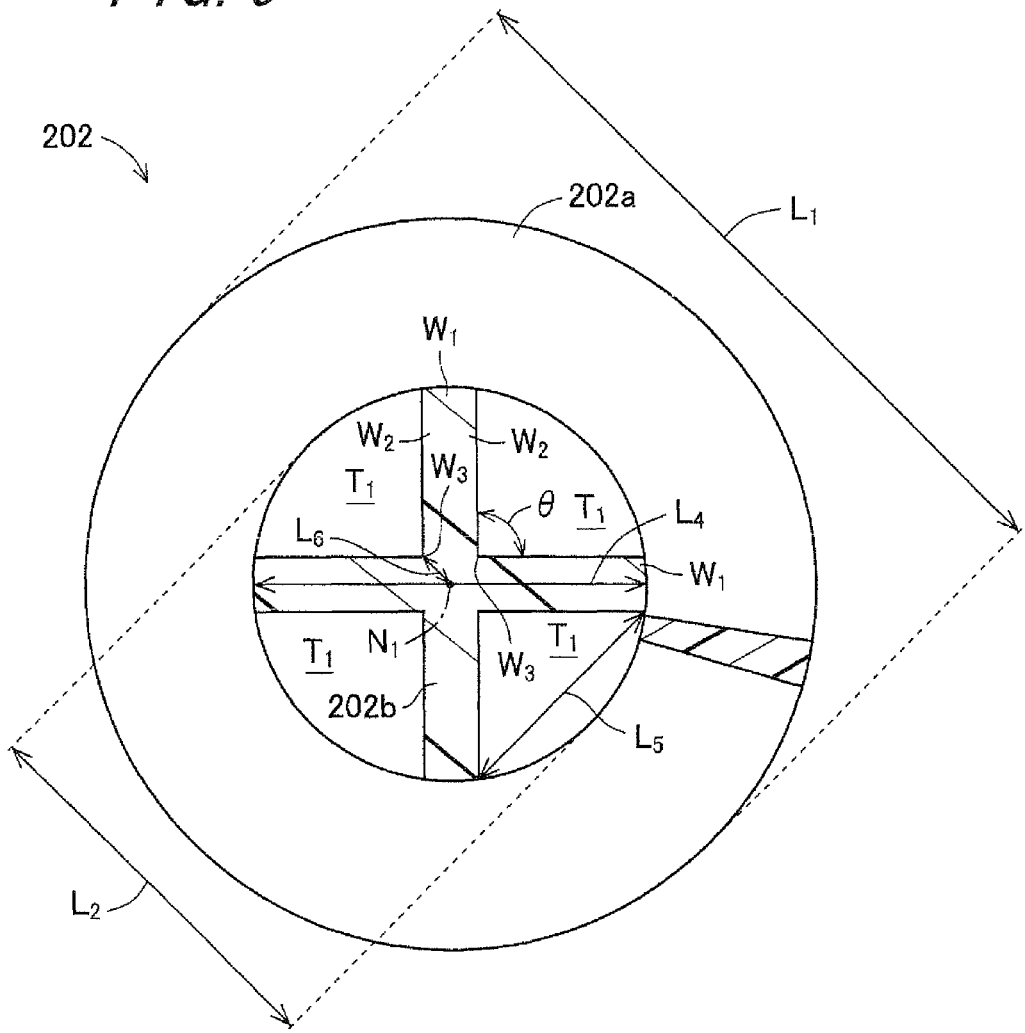
FIG. 9 is a cross-sectional view orthogonal to an axial line of the first developer conveying section.

FIG. 7 is a perspective view illustrating the first developer conveying section 202. FIG. 8 is an exploded view illustrating the first developer conveying section 202. FIG. 9 is a cross-sectional view orthogonal to an axial line $N_1$ of the first developer conveying section 202. As described above, the first developer conveying section 202 includes the first spiral blade 202*a*, the first rotation shaft member 202*b*, the first supporting member 202*c*, and the first gear 202*d*.

The first spiral blade 202*a*, the first rotation shaft member 202*b*, the first supporting member 202*c*, and the first gear 202*d* are formed of a material such as polyethylene, polypropylene, high impact polystyrene, or an ABS resin (acrylonitrile butadiene styrene copolymer synthetic resin). When the first spiral blade 202*a*, the first rotation shaft member 202*b*, the first supporting member 202*c*, and the first gear 202*d* are formed of the same material, it is preferable that the first developer conveying section. 202 is formed integrally.

The first spiral blade 202*a* is a member that is spirally wound around the first rotation shaft member 202*b*, and has a substantially annular shape when viewed from the direction of the axial line $N_1$. More specifically, the first spiral blade 202*a* is a member with a predetermined thickness, which has a plane made up by a trajectory of a line segment when the line segment is made to move along a spiral. Here, "spiral" is a continuous spatial curve on a side surface of an imaginary column which proceeds in one axial line direction of the imaginary column while proceeding in one circumferential direction of the imaginary column.

A value of two times a distance from the axial line $N_1$ to a point, which is farthest from the axial line $N_1$, on the first spiral blade 202*a* is referred to as an outer diameter $L_1$ of the first spiral blade 202*a*. In addition, a value of two times a distance from the axial line $N_1$ to a point, which is nearest to the axial line $N_1$, on the first spiral blade 202*a* is referred to as an inner diameter $L_2$ of the first spiral blade 202*a*. The outer diameter $L_1$ of the first spiral blade 202*a* is appropriately set within a range of 15 mm or more and 40 mm or less, and the inner diameter $L_2$ of the first spiral blade 202*a* is appropriately set within a range of 8 mm or more and 20 mm or less. In addition, a thickness $L_3$ of the first spiral blade 202*a* is appropriately set within a range of 1 mm or more and 3 mm or less.

The first rotation shaft member 202*b* is a columnar member that extends in the axial line $N_1$ direction, and four grooves $T_1$ are formed therein. The four grooves $T_1$ have the same V-shape and the same size as each other in a cross section orthogonal to the axial line $N_1$, and are equally spaced in a circumferential direction of the first rotation shaft member 202*b*. Therefore, a cross section of the first rotation shaft member 202*b* has a substantially cross shape in a direction orthogonal to the axial line $N_1$.

In regard to the first rotation shaft member 202*b*, a portion that is farthest from the axial line $N_1$ is referred to as an outer edge of the first rotation shaft member 202*b*. A value of two times a distance from the axial line $N_1$ to an outer edge $W_1$ is referred to as an outer diameter $L_4$ of the first rotation shaft member 202*b*. In this embodiment, the first spiral blade 202*a* is fixed to the first rotation shaft member 202*b* in a state where the first spiral blade 202*a* comes into contact with only the outer edge $W_1$ of the first rotation shaft member 202*b*.

In regard to the first rotation shaft member 202*b*, a portion surrounding the grooves $T_1$ is referred to as a groove portion $W_2$. In regard to the groove portion $W_2$, a portion that is nearest from the axial line $N_1$ is referred to as a bottom $W_3$ of the groove portion $W_2$. In regard to a cross section perpendicular to the axial line $N_1$, a distance between two points, spaced from each other by one groove $T_1$, in the nearest outer edges $W_1$ is referred to as an opening width $L_5$ of the groove $T_1$. regard to a cross section orthogonal to the axial line $N_1$, an angle made by a straight line connecting a point in two points, spaced from each other by one groove $T_1$, in the nearest outer edges $W_1$, and the bottom $W_3$ of the groove portion $W_2$ surrounding one grove $T_1$ and a straight line connecting the other point in the two points and the $W_3$ of the groove portion $W_2$ is referred to as a central angle θ of the groove $T_1$. In this embodiment, the central angle θ of the groove $T_1$ is 90°.

The outer diameter $L_4$ of the first rotation shaft member 202*b* is appropriately set within a range of 8 mm or more and 15 mm or less. In this embodiment, the first spiral blade 202*a* comes into contact with the outer edge $W_1$ of the first rotation shaft member 202*b*, so that the inner diameter $L_2$ of the first spiral blade 202*a*, and the outer diameter $L_4$ of the first rotation shaft member 202*b* are identical with each other. The opening width $L_5$ of the groove $T_1$ is appropriately set within a range of 4 mm or more and 8 mm or less. A distance $L_6$ from the axial line $N_1$ to the bottom $W_3$ of the groove portion $W_2$ is appropriately set with a range of 3 mm or more and 6 mm or less. The central angle θ of the groove $T_1$ was appropriately set within a range of 90° or more and 120° or less.

The first rotation shaft member 202*b* of the first developer conveying section 202 has high rigidity in a direction orthogonal to the axial line $N_1$ direction compared to a columnar rotation shaft member without the groove which has the same cross-sectional area in the axial line $N_1$ direction. Therefore, the first developer conveying section 202 is hard to be bent. In addition, the first rotation shaft member 202*b* has a shape in which the grooves $T_1$ extending in the axial line $N_1$ direction are formed, so that the first rotation shaft member 202*b* has a small occupying volume in the developer tank 201 compared to a columnar rotation shaft member without grooves having the same outer diameter. Therefore, it is possible to store a large amount of developer in the developer tank 201. Therefore, the developing device 200 according to this embodiment can secure an amount of developer that can be stored in the developer tank 201 while suppressing bending of the first developer conveying section 202. As a result, it is possible to realize the decrease in size, and furthermore, it is possible to realize the decrease in size of the image forming apparatus 100.

In addition, the first developer conveying section 202 can bear the developer at the groove portion $W_2$, and agitate the developer in the circumferential direction of the first rotation shaft member 202*b*. Therefore, the developing device 200 according to the embodiment can quickly charge the developer, and as a result, it is possible to realize the increase in developing process speed.

Figure 10:
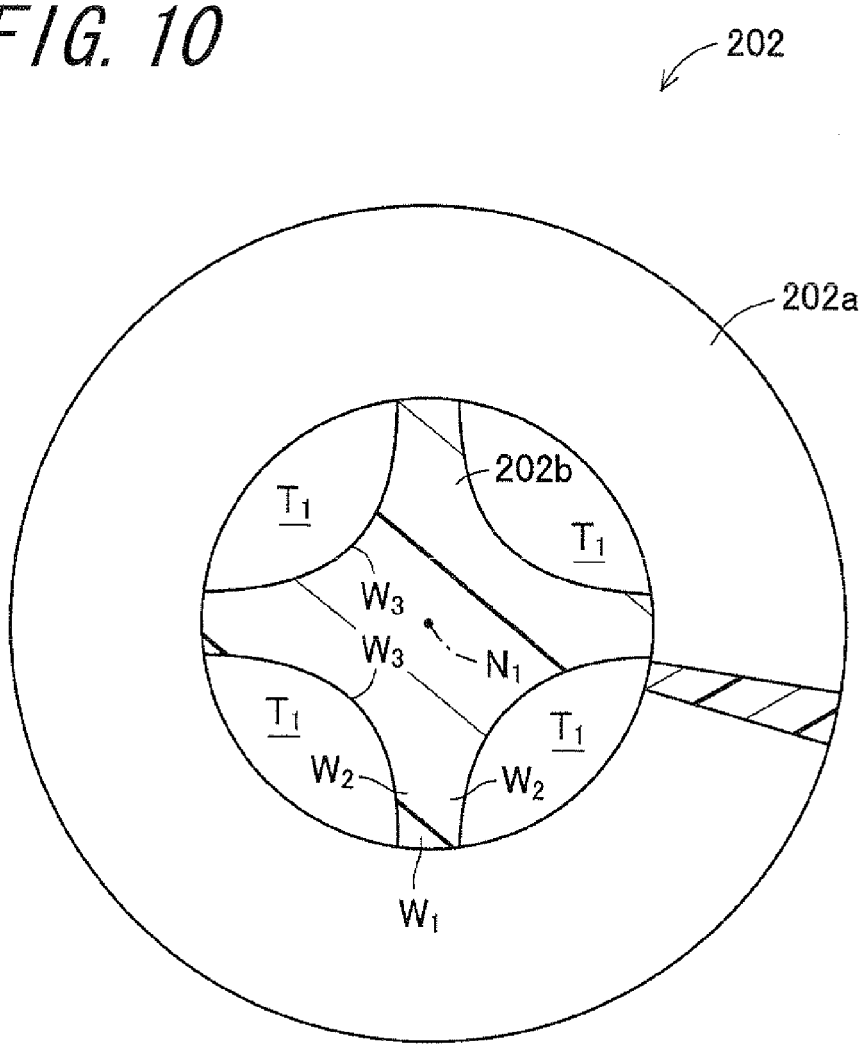
FIG. 10 is a diagram illustrating another embodiment.

In this embodiment, the shape of the grooves $T_1$ is set to a V-shape, but in another embodiment, the shape of the grooves $T_1$ may be set to a U-shape. FIG. 10 is a diagram illustrating another embodiment. FIG. 10 corresponds to FIG. 9. In the embodiment shown in FIG. 10, the shape of the grooves $T_1$ in a cross section that is orthogonal to the axial line $N_1$ direction of the first rotation shaft member 202*b* is a U-shape. In this manner, when the shape of the grooves $T_1$ is set to a V-shape or U-shape, it is possible to suppress the developer from remaining in the grooves In. addition, in the embodiment, the shape of the grooves $T_1$ may be a rectangular shape instead of the V-shape or U-shape.

In. addition, in this embodiment, the number of the grooves $T_1$ is 4. It is preferable that the number of the grooves $T_1$ is 3 or more and 5 or less, as in this embodiment. When the number of grooves $T_1$ is 2 or less, it is apt to be bent in a specific direction. In addition, in a case where an area of cross section orthogonal to the axial line $N_1$ direction of the first rotation shaft member 202*b* is made to be constant, when the number of grooves $T_1$ is 6 or more, the area of cross section orthogonal to the axial line $N_1$ direction in each of the grooves $T_1$ becomes small compared to a case where the number of the grooves $T_1$ is 5 or less, and as a result, the amount of developer that can be borne in the groove portion $W_2$ surrounding the grooves $T_1$ decreased and therefore an agitating effect of the developer is decreased. Contrary to this, when the number of grooves $T_1$ is 3 or more and 5 or less, it is hard to be bent in a specific direction, and it is possible to sufficiently agitate the developer and to charge the developer.

In addition, it is preferable that the grooves $T_1$ are equally spaced in the circumferential direction of the first rotation shaft member 202*b* in regard to a cross section orthogonal to the axial line $N_1$ direction, as in this embodiment. When the first rotation shaft member 202*b* is configured in this manner, it is possible to suppress the bending of the first developer conveying section 202 equally in all directions orthogonal to the axial line $N_1$ direction of the first rotation shaft member 202*b*.

In addition, in this embodiment, the first spiral blade 202*a* comes into contact with only the outer edge $W_1$ of the first rotation shaft member 202*b*. Therefore, a gap is formed between the first spiral blade 202*a* and the groove portion $W_2$ of the first rotation shaft member 202*b*. In addition, as another embodiment, the entirety or a part of the gap between the first spiral blade 202*a* and the groove portion $W_2$ of the first rotation shaft member 202*b* may be filled.

In this embodiment in which the first spiral blade 202*a* comes into contact with only the outer edge $W_1$, it is possible to bear the developer in a groove portion $W_2$ facing the first spiral blade 202*a* as well as in a groove portion $W_2$ not facing the first spiral blade 202*a* and agitate the developer in a circumferential direction of the first rotation shaft member 202*b*. Therefore, in this embodiment, it is possible to quickly charge the developer compared to a state where a gap between the first spiral blade 202*a* and the groove portion $W_2$ of the first rotation shaft member 202*b* is filled.

Figure 11:
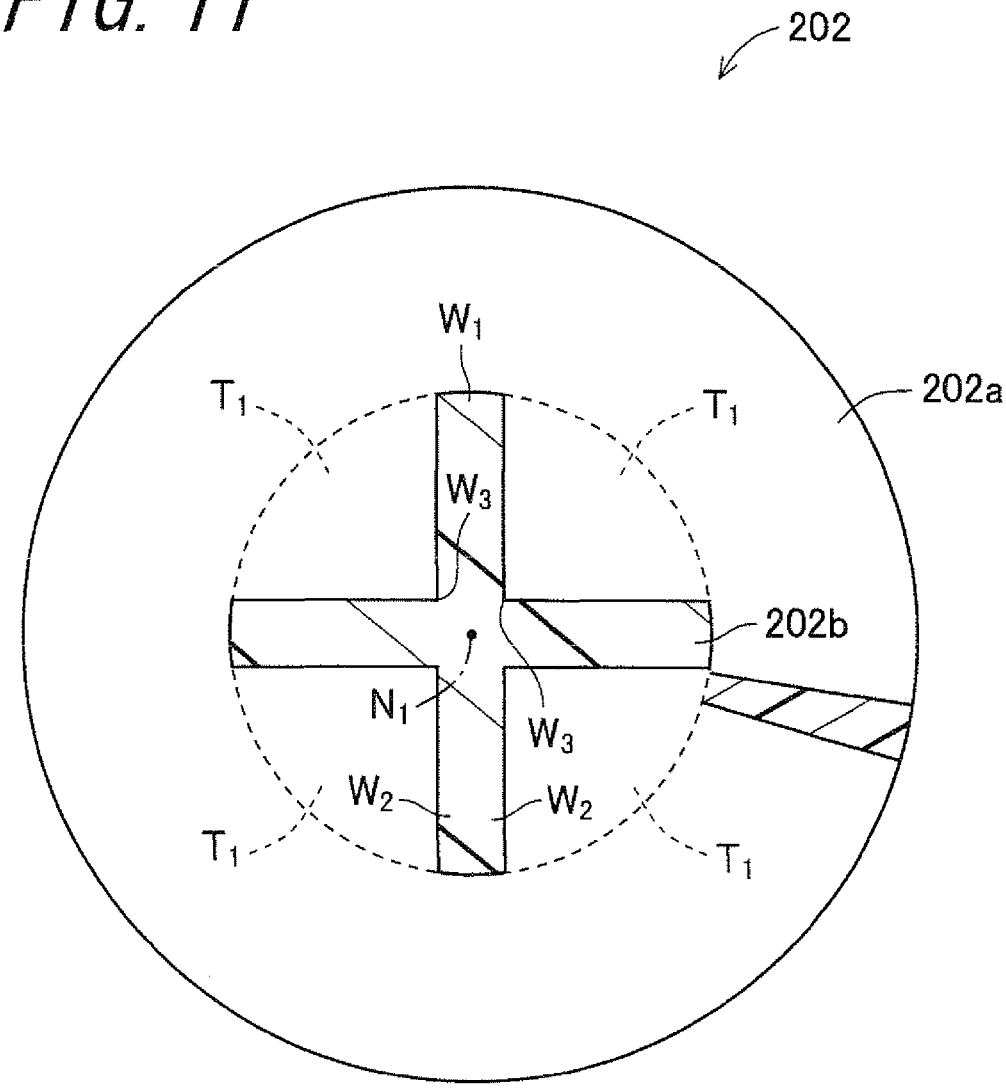
FIG. 11 is a diagram illustrating another embodiment.

Hereinafter, another embodiment will be described. FIG. 11 is a diagram illustrating another embodiment. FIG. 11 corresponds to FIG. 9. In the embodiment shown in FIG. 11, the first spiral blade 202*a* comes into contact with the groove portion $W_2$ of the first rotation shaft member 202*b* such that a gap does not occur between the first spiral blade 202*a* and the groove portion $W_2$. In a case where the first spiral blade 202*a* is configured in this manner, a developer conveying speed with respect to the conveying direction X is increased compared to a state where the gap occurs between the first spiral blade 202*a* and the groove portion $W_2$ of the first rotation shaft member 202*b*, and therefore this conveying speed becomes substantially the same level as in a developer conveying section that includes a columnar rotation shaft member without the groove which has the same cross-sectional area in the axial line $N_1$ direction. Therefore, in a case where agitation charging of the developer is sufficient, when using a first developer conveying section 202 including the first rotation shaft member 202*b* in which a gap does not occur between the first rotation shaft member 202*b* and the groove portion $W_2$, it is possible to perform the developing process at a high speed.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developing device comprising:

a developer tank that stores developer;

a developer conveying section provided in the developer tank, including:

a rotation shaft member having a columnar shape in which grooves extending in an axial line direction of the rotation shaft member are formed, outer edges of the rotation shaft member being located at positions farthest from the axial line in a radial direction, and a spiral blade that is spirally wound around the rotation shaft member and conveys developer by rotation around the axial line of the rotation shaft member, wherein an inner edge of the spiral blade contacts only the outer edges of the rotation shaft member, wherein the grooves form gaps between the spiral blade and the rotation shaft member, and wherein a height of the spiral blade in a radial direction is greater than a depth of the grooves in a radial direction; and a developing roller that bears and supplies the developer.

2. The developing device of claim 1, wherein a shape of the grooves is a V-shape or U-shape in a cross section orthogonal to the axial line direction.

3. The developing device of claim 1, wherein a number of the grooves is 3 or more and 5 or less.

4. The developing device of claim 3, wherein the grooves are formed to be equally spaced in a circumferential direction of the rotation shaft member in regard to a cross section orthogonal to the axial line direction.

5. An electrophotographic image forming apparatus comprising: the developing device of claim 1.

6. A developing device comprising:

a developer tank that stores developer;

a developer conveying section provided in the developer tank, including:

a rotation shaft member having a columnar shape in which grooves extending in an axial line direction of the rotation shaft member are formed, outer edges of the rotation shaft member being located at positions farthest from the axial line in a radial direction, and a spiral blade that is spirally wound around the rotation shaft member and conveys developer by rotation around the axial line of the rotation shaft member, and wherein a height of the spiral blade in a radial direction is greater than a depth of the grooves in a radial direction; and a developing roller that bears and supplies the developer.

7. The developing device of claim 6, wherein an inner edge of the spiral blade contacts only the outer edges of the rotation shaft member.

8. The developing device of claim 6, wherein the grooves form gaps between the spiral blade and the rotation shaft member.

9. The developing device of claim 6, wherein no gaps are formed between the spiral blade and the rotation shaft member.

10. The developing device of claim 6, wherein a shape of the grooves is a V-shape or U-shape in a cross section orthogonal to the axial line direction.

11. The developing device of claim 6, wherein a number of the grooves is 3 or more and 5 or less.

12. The developing device of claim 6, wherein the grooves are formed to be equally spaced in a circumferential direction of the rotation shaft member in regard to a cross section orthogonal to the axial line direction.

13. An electrophotographic image forming apparatus comprising the developing device of claim 6.

* * * * *